US010894333B2

(12) United States Patent
Turatti

(10) Patent No.: US 10,894,333 B2
(45) Date of Patent: Jan. 19, 2021

(54) MACHINES FOR FORMING SPAGHETTI FROM VEGETABLE PRODUCTS

(71) Applicant: TURATTI S.R.L., Venice (IT)

(72) Inventor: Antonio Turatti, Venice (IT)

(73) Assignee: TURATTI S.R.L., Venice (IT)

( * ) Notice: Subject to any disclaimer, the term of this patent is extended or adjusted under 35 U.S.C. 154(b) by 0 days.

(21) Appl. No.: 16/469,331

(22) PCT Filed: Dec. 12, 2017

(86) PCT No.: PCT/IT2017/050005
§ 371 (c)(1),
(2) Date: Jun. 13, 2019

(87) PCT Pub. No.: WO2018/109791
PCT Pub. Date: Jun. 21, 2018

(65) Prior Publication Data

US 2020/0023535 A1 Jan. 23, 2020

(30) Foreign Application Priority Data

Dec. 14, 2016 (IT) ..... 102016000126477

(51) Int. Cl.
*B26D 3/26* (2006.01)
*B26D 1/29* (2006.01)
*B26D 7/06* (2006.01)

(52) U.S. Cl.
CPC ..... *B26D 3/26* (2013.01); *B26D 1/29* (2013.01); *B26D 7/0625* (2013.01)

(58) Field of Classification Search
CPC ..... B26D 3/26; B26D 1/29; B26D 7/0625
See application file for complete search history.

(56) References Cited

U.S. PATENT DOCUMENTS 5,042,342 A * 8/1991 Julian ..... B26D 1/29 83/402
5,174,181 A * 12/1992 Julian ..... B26D 1/29 83/24

(Continued)

FOREIGN PATENT DOCUMENTS

EP 0412835 A2 2/1991
WO 9307999 A1 4/1993

OTHER PUBLICATIONS

International Search Report dated Feb. 21, 2018 from PCT Application No. PCT/IT2017/050005.

(Continued)

*Primary Examiner* — Omar Flores Sanchez
(74) *Attorney, Agent, or Firm* — Innovation Capital Law Group, LLP; Vic Lin

(57) ABSTRACT

Machine for forming spaghetti of vegetable products (19) comprising—a cutting unit (11) rotatable about an operating axis (A) and having a face (12), perpendicular to the operating axis (A), from which blades (13) protrude to form spaghetti from a product (19) that is pushed against the face (12);—a supply device (14) comprising a thrust unit (15) having:—two mutually opposite tape members (16, 17), which between them define a passage (18) for products (19) and can be spread symmetrically with respect to the operating axis (A);—elastic means (20) connected to said tape members (16, 17) and configured to resiliently oppose a mutual divergence of said tape members (16, 17). The tape members (16, 17) are positioned and configured in such a way that the passage (18) extends along the operating axis (A) and has an outlet opening (18*a*) which faces the face (12) of the cutting unit (11).

7 Claims, 4 Drawing Sheets

(56) References Cited

U.S. PATENT DOCUMENTS

| | | | | |
|---|---|---|---|---|
| 5,343,791 | A * | 9/1994 | Julian | B26D 1/29 83/402 |
| 8,474,357 | B2 * | 7/2013 | Stanojevic | B26D 1/553 414/749.1 |
| 9,221,186 | B2 * | 12/2015 | Scaroni | B26D 1/143 |
| 2006/0225547 | A1 * | 10/2006 | Stanojevic | B26D 1/553 83/13 |
| 2009/0056519 | A1 * | 3/2009 | Moore | B26D 1/24 83/873 |
| 2012/0064214 | A1 * | 3/2012 | Moore | B26D 1/15 426/518 |
| 2016/0288353 | A1 * | 10/2016 | McCracken | B26D 7/01 |
| 2018/0071936 | A1 * | 3/2018 | Jacko | B26D 1/29 |
| 2018/0199613 | A1 * | 7/2018 | Vougioukas | B26D 7/0625 |
| 2019/0030740 | A1 * | 1/2019 | Grasselli | B26D 7/2628 |
| 2019/0232516 | A1 * | 8/2019 | Volkl | B26D 5/06 |

OTHER PUBLICATIONS

Italian Search Report dated Aug. 16, 2017 from Italian Application No. 102016000126477.

* cited by examiner

MACHINES FOR FORMING SPAGHETTI FROM VEGETABLE PRODUCTS

The present invention relates to a machine for forming spaghetti from vegetable products.

In particular, the present invention refers to a machine for forming spaghetti from carrot, zucchini, pumpkins and the like.

Nowadays the need to provide culinary products made from raw vegetable materials is increasingly felt.

In particular, spaghetti made from carrots or zucchini are requested.

A machine for forming spaghetti from carrots or zucchini, known today, comprises a rotating support adapted to house a product.

This rotating support has an inlet opening and an outlet opening in front, to which a fixed blade is located, suitably shaped for cutting the product, which is dragged in rotation by the support, according to a helical trajectory in order to obtain a plurality of spaghetti.

A pusher is configured to insert a product through the inlet opening and to push it against the blade.

The feed speed of the pusher and the speed of rotation of the support determine the pitch of the propeller by which, the product is cut by the blade.

This machine is much appreciated, however, needs some improvements.

In particular, it results to have a low productivity as the products can be inserted in the support only, one at a time.

Moreover, the support allows the introduction of products having an overall width comprised in an interval of width quite limited.

The problem underlying the present invention is that of providing a machine for forming spaghetti from vegetable products which has an increased productivity and is more flexible in use.

The main object of the present invention is to provide a machine for forming spaghetti from vegetable products that provides a solution to this problem by solving the complaints of the machine to form spaghetti from vegetable products described above.

Within this aim, the object of the present invention is to provide that of.

Another object of the present invention is to realize a machine for forming spaghetti from vegetable products that allows to work a continuous series of vegetable products.

Another object of the invention is to provide a machine for forming spaghetti from vegetable products that allows to work a wider range of sizes of vegetable products.

A further object of the invention is to provide a machine for forming spaghetti from vegetable products which is structurally simple and easy to manufacture and use.

This task, as well as these and other objects which will become better apparent hereinafter, are achieved by a machine for forming spaghetti from vegetable products according to the attached claim 1.

Detailed features of a machine for forming spaghetti from vegetable products according to the invention are reported in the corresponding dependent claims.

Further characteristics and advantages of the invention will become better apparent from the description of a preferred but not exclusive embodiment of a machine for forming spaghetti from vegetable products according to the invention, illustrated by way of non-limiting example in the accompanying drawings, in which.

Figure 1:
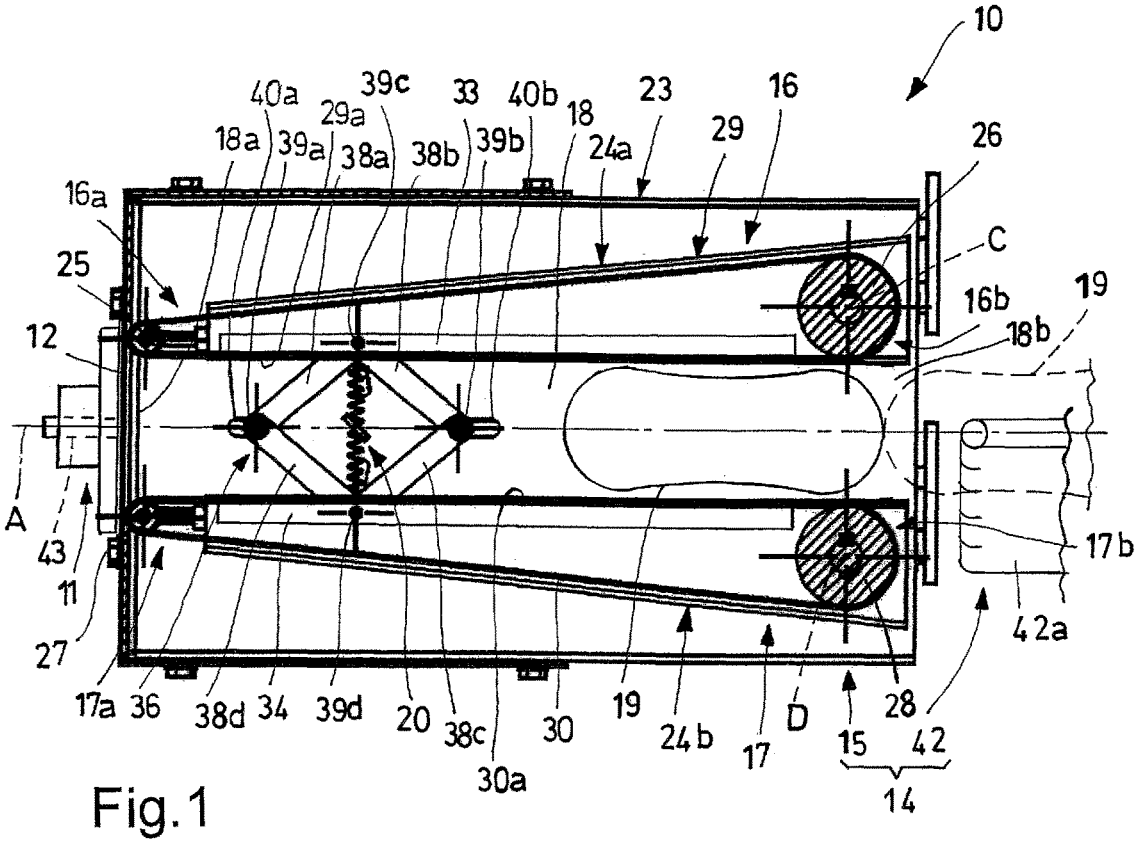
FIG. 1 shows a machine for forming spaghetti from vegetable products according to the present invention, in cross-section.

With particular reference to the above figures, it is generally indicated with 10 a machine for forming spaghetti from vegetable products which, in a traditional way comprising a cutting unit 11 which is rotatable about an operating axis A and having a face 12, perpendicular to the operating axis A, from which blades protrude, generally indicated with 13, to form spaghetti from a product 19 which is pushed against the face 12.

The machine 10, according to the present invention, has a particular peculiarity in the fact of comprising a supply device 14 comprising a thrust unit 15 having:

two tape members 16 and 17, mutually opposing each other, and define a passage 18 for products 19 between them.

The tape members 16 and 17 are positioned and configured such that the passage 18 extends along the operating axis A and has an outlet opening 18*a* which faces the face 12 of the cutting unit 11.

The tape members 16 and 17 are furthermore preferably symmetrically spreadable with respect to the operating axis A.

The thrust unit 15 also comprises elastic means 20 connected to the tape members 16 and 17 and configured to resiliently oppose a mutual divarication of the tape members 16 and 17.

In practice, when a product 19 is inserted between the tape members 16 and 17, they adapt to the size of the product 19, divaricating themselves, in contrast with the elastic means 20 or approaching each other by the same elastic means 20 until they meet the product 19.

In this way, the thrust unit 15 is adaptable to products 19 of a wide range of dimensions.

The elastic means 20 are also dimensioned to exert on the tape members 16 and 17 a force, adequate to effectively make the latter, encounter a product 19 between them without, however, exerting a stress on the product 19 which could damage it.

Clearly, the tape members are operable to drag the product 19 along the passage 18 along the operating axis A.

For this purpose, the thrust unit 15 comprises at least one motor and, preferably, two motors 21 and 22 each connected to a tape member 15 to operate it.

In the preferred but not exclusive embodiment, illustrated in the accompanying figures, the elastic means are advantageously constituted by helical traction springs, bridged between the tape members 15 to counteract their divarication.

In practice, during use of the machine 10 according to the present invention, a continuous series of products 19 can be fed into the thrust unit 15 where said products form a line made to advance, without the need for interruptions in processing, up to the cutting unit 11 where from them spaghetti are obtained.

In this way, a machine 10 according to the present invention makes it possible to greatly increase productivity with respect to conventional machines for forming spaghetti from vegetable products which provides a discontinuous process of a product at a time.

The operating speed of the tape members 15, which determines the feed speed of the products 19, and the rotational speed of the cutting unit 11 are advantageously coordinated.

Moreover, inside the thrust unit, each product pushes the precedent against the face 12 of the cutting unit 11 so that there are no end sections to be discarded, as in the aforementioned traditional machine, to the advantage of productivity and efficiency.

Advantageously, the thrust unit 15 comprises a fixed frame 23 to which the tape members 16 and 17 are rotatably pivoted each with respect to its own axis of tilting C, D which lies on a plane perpendicular to the operating axis A.

The axes of tilting C, D are mutually parallel.

Structurally, the tape members 16 and 17 preferably have respective front ends d, which define the outlet opening 18*a* of the passage 18, and the rear ends 16*b*, 17*b* which define an inlet opening 18*b* of the passage 18 and which are pivoted to the fixed frame 23 in a rotatable manner with respect to the axes of tilting C, D.

Each of the tape members 16 and 17 advantageously comprises:

- a mobile frame 24*a*, 24*b*,
- two pulleys 25, 26 and 27, 28 rotatably coupled to the mobile frame 24*a*, 24*b*,
- a ribbon-like element 29, 30 forming a loop and mounted on the pulleys 25, 26 and 27, 28 so as to have a substantially rectilinear tract 29*a*, 30*a* which extends between the pulleys 25, 26 and 27, 28 and is suitable to encounter a product 19, to drag it, in use, along the operating axis A.

The tape members 16 and 17 advantageously have, each a concave branch 31, 32 having a concavity facing the operating axis A.

The concave branches 31, 32 are mutually facing each other so as to define two sides, preferably one superior and one inferior, of the passage 18.

Figure 8:
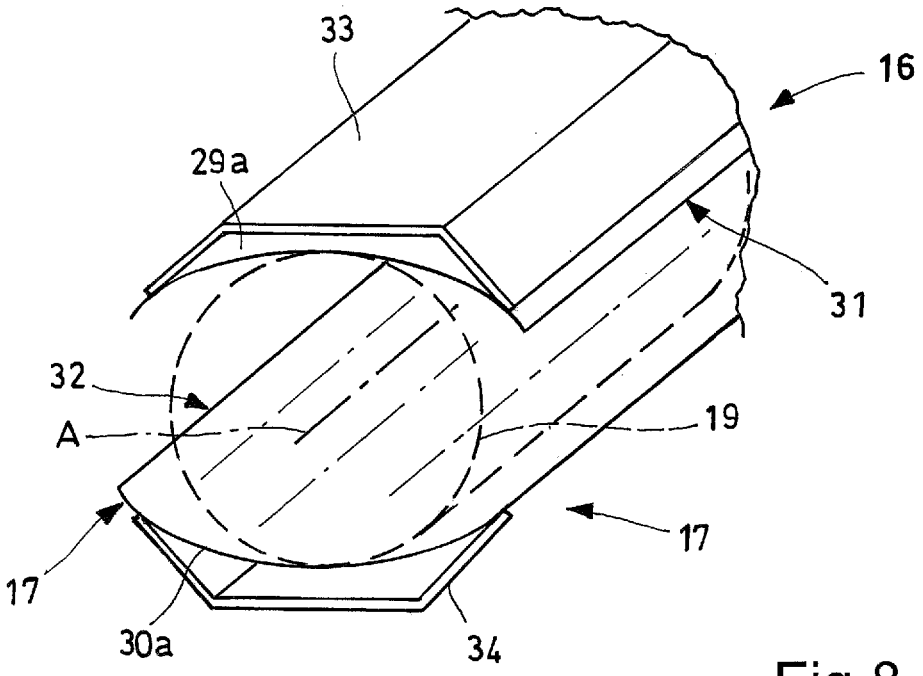

The concavity of the concave branches 31, 32 is advantageously predefined to center on the operating axis A, a product 19 which in use crosses the passage 18, as for example visible in FIG. 8.

Each of the tape members 16 and 17 comprises a formed guide 33, 34 on which the tract 29*a*, 30*a* of said ribbon-like element 29, 30, in use, slides.

The formed guide 33, 34 is configured in such a way as to elastically deform the tract 29*a*, 30*a* so that this defines the concave branch 31, 32.

The thrust unit 15 advantageously comprises a guide device 35 which mutually interconnects the tape members 16 and 17 and which is configured to guide them between two configurations, one of closing and one of opening, in which the tape members 16 and 17 have minimum divarication and a maximum divarication respectively.

The guide device 35 is configured to maintain the tape members 16 and 17 in mutually symmetrical positions with respect to the operating axis A, for guiding a product 19 coaxially to the operating axis A.

More in detail, the guide device 35 advantageously comprises at least one guide mechanism, and preferably two guide mechanism 36, 37 as better specified below.

Each guide mechanism 36, 37 advantageously comprises four connecting rods 38*a*, 38*b*, 38*c*, 38*d* and four pins 39*a*, 39*b*, 39*c*, 39*d* arranged to form a quadrilateral whose sides are defined by the connecting rods 38*a*, 38*b*, 38*c*, 38*d* and at the vertices, the pins 39*a*, 39*b*, 39*c*, 39*d* are placed, each of which connects, in a mutual rotatable manner, two adjacent connecting rods 38*a*, 38*b*, 38*c*, 38*d*.

The fixed frame 23 is advantageously provided with two rectilinear guides 40*a*, 40*b*, parallel to said operating axis A, and two curvilinear guides 41*a*, 41*b* each developing circumferentially to one of the axes of tilting C, D.

The pins 39*a*, 39*b*, 39*c*, 39*d* comprise:

- two first pins 39*a*, 39*b* defining two mutually opposite vertexes of the quadrilateral, each of which is coupled to one of the rectilinear guides 40*a*, 40*b* to slide parallel to the operating axis A;
- two second pins 39*c*, 39*d* defining mutually opposite vertexes of the quadrilateral, each of which is coupled to one of the curvilinear guides 41*a*, 41*b* to slide along the curvilinear guides, each circumferentially to a respective axis of tilting C, D.

Each of the second pins 39*c*, 39*d* is fixed to one of the tape members 16 and 17 to guide it.

The guides 40*a*, 40*b*, 41*a*, 41*b* are advantageously grooves in which the respective pins 39*a*, 39*b*, 39*c*, 39*d* are slidably inserted.

Advantageously, the guide device 35 comprises two guide mechanism 36, 37 arranged laterally to the tape members 16 and 17 so as to include them in between.

The supply device 14 preferably also comprises a supply group 42 adapted to introduce products 19 into the thrust unit 15 parallel to and preferably coaxial with the operating axis A.

Figure 2:
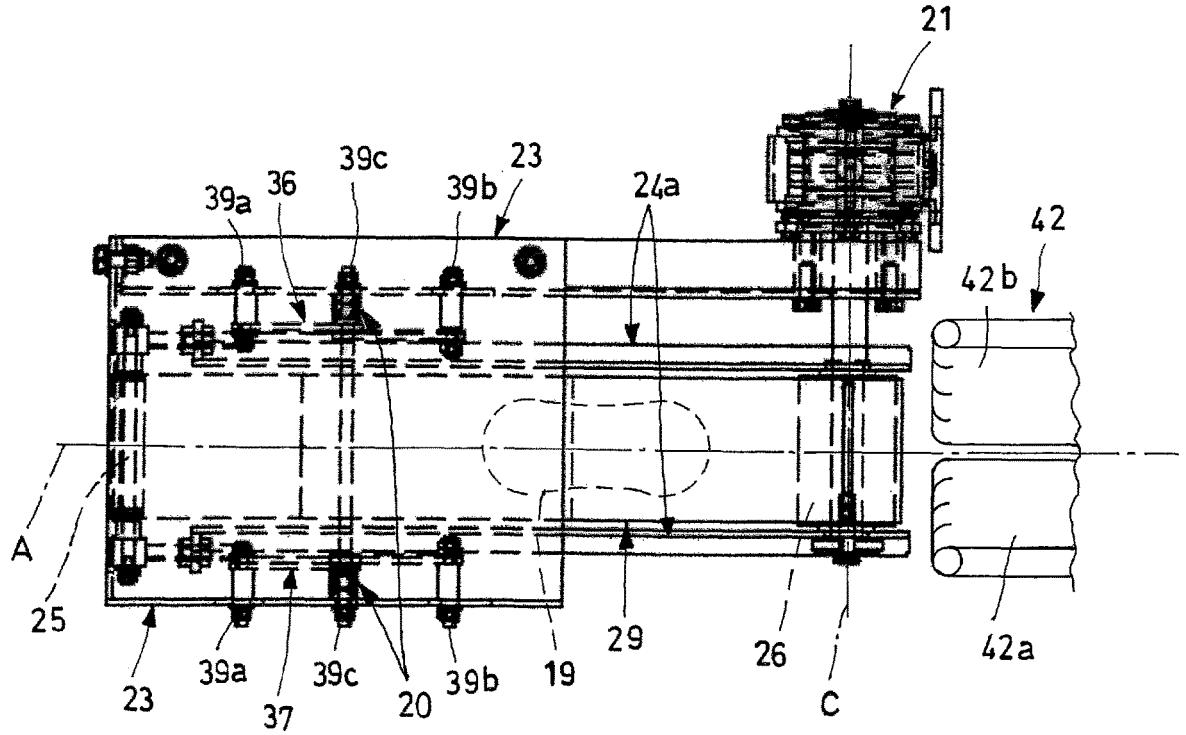
FIG. 2 illustrates the machine for forming spaghetti from vegetable products of FIG. 1, in plan view from above.
Figure 3:
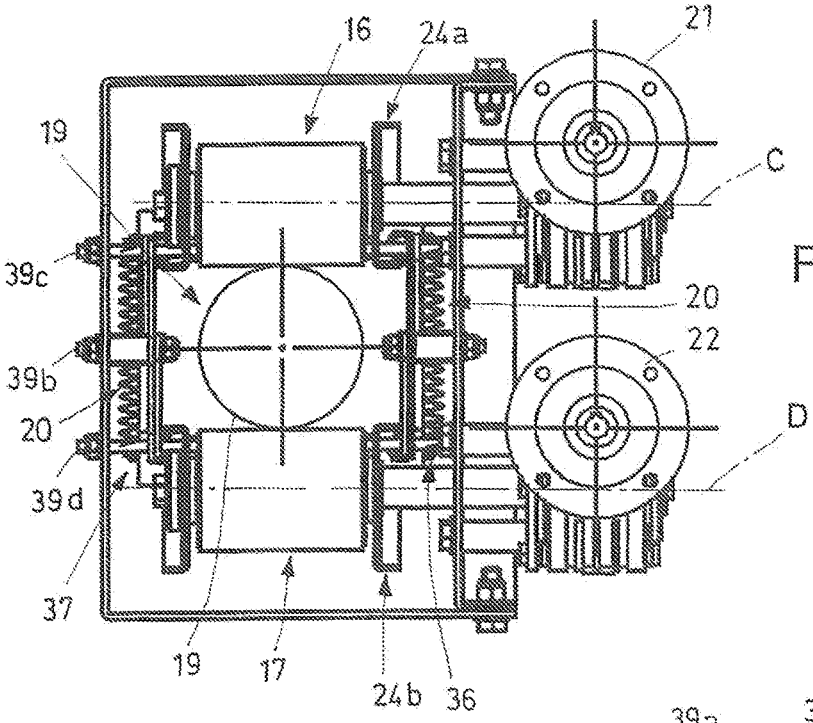
FIG. 3 illustrates the machine for forming spaghetti from vegetable products of FIGS. 1 and 2, frontal viewed from behind with some parts removed to highlight better others.
Figure 4:
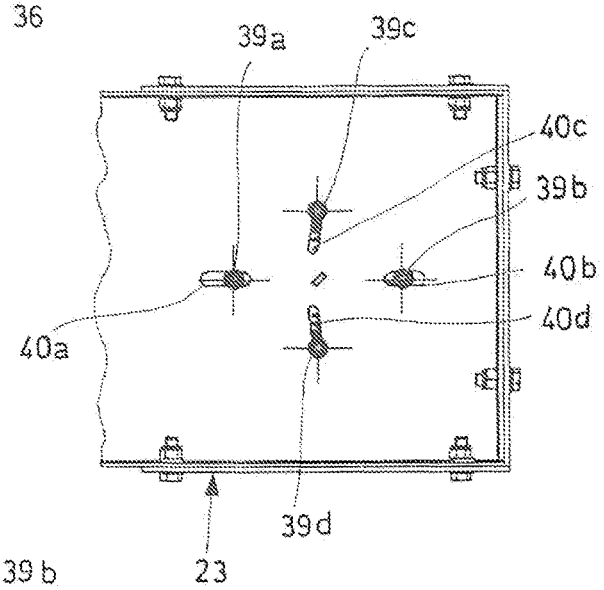
FIG. 4 illustrates the machine for forming spaghetti from vegetable products of the preceding figures, viewed from the side.
Figure 5:
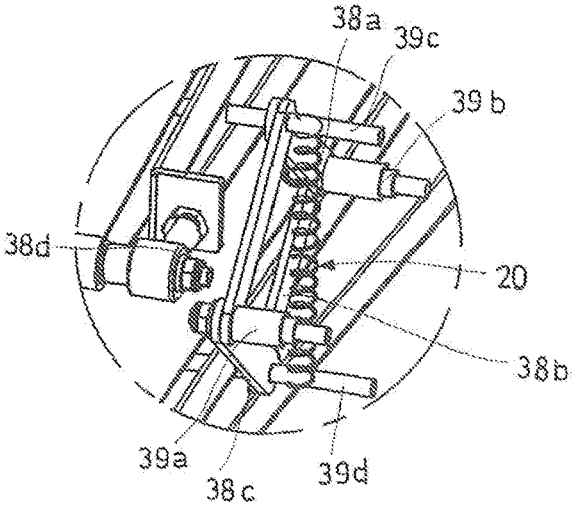
FIG. 5 illustrates the particular V of FIG. 6.
Figure 6:
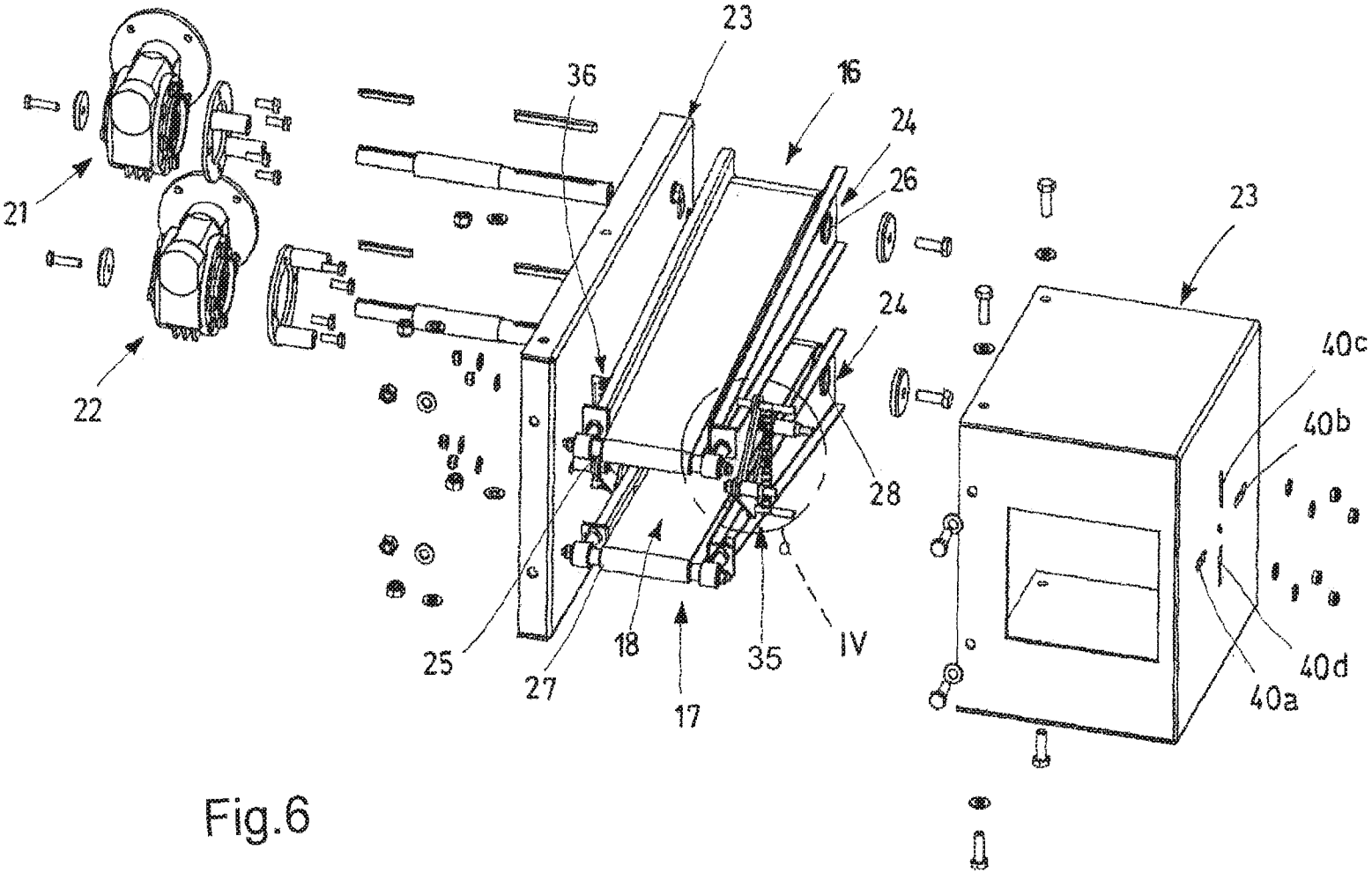
FIG. 6 illustrates a machine for forming spaghetti from vegetable products according to the present invention, from an exploded perspective viewed.

In detail, the supply group 42 advantageously comprises a pair of conveyor belts 42*a*, 42*b* arranged in a V shape, as illustrated for example in FIGS. 1 and 2.

Figure 7:
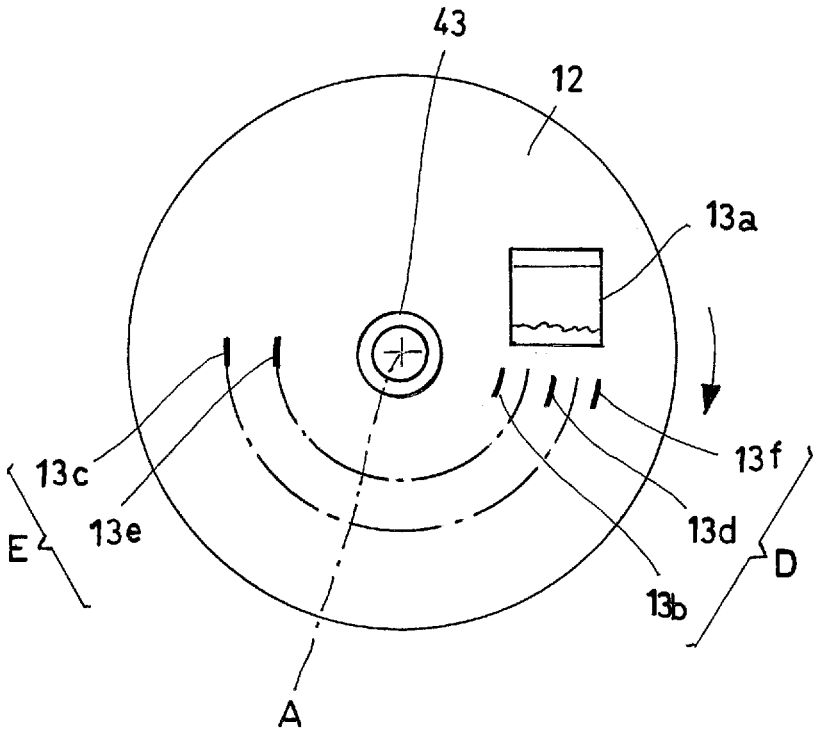
FIGS. 7 and 8 show two details from a machine for forming spaghetti of vegetable products according to the present invention.

With particular reference to FIG. 7, the cutting unit 11 comprises:

- a first blade 13*a* which has a cutting edge substantially parallel to and spaced with respect to the face 12;
- second blades 13*b*, 13*c*, 13*d*, 13*e* and 13*f* that are collectively aligned circumferentially to the first blade 13*a*.

The second blades 13*b*, 13*c*, 13*d*, 13*e* and 13*f* advantageously protrude perpendicularly from the face 12 and, on this, are positioned on concentric circumferences to the operative axis A, preferably at regular space intervals in the radial direction to the operative axis A.

Advantageously, the second blades 13*b*, 13*c*, 13*d*, 13*e* and 13*f* are divided into two groups D and E, diametrically opposite to the operating axis A.

Preferably, the first blades belong to the first group D which, if counted in a radial direction to the operating axis, they have an odd numbering and those with an even numbering belong to the second group E.

In this way the blades, with respect to the aforementioned radial direction, alternately belong to the first and second groups respectively.

In this way it was found that the working stresses exerted, in use, on the cutting unit 11 are more balanced from a dynamic point of view, to the full advantage of the durability and efficiency of the machine 10.

In a traditional way, central to the face 12 and coaxial to the operating axis A, a tubular blade is provided for removing a central cylinder, or core, of the product 19.

The invention thus conceived is susceptible of numerous modifications and variations, all of which are within the scope of protection of the appended claims.

Furthermore, all the details may be replaced by other technically equivalent elements.

In practice, the materials used, as well as the contingent shapes and dimensions, may be varied according to the contingent requirements and the state of the art.

Where the constructional features and techniques mentioned in the following claims are followed by signs or reference numbers, such reference marks or numbers have been affixed with the sole purpose of increasing the intelligibility of the claims themselves and, consequently, they do not constitute no restriction on the interpretation of each element identified, purely by way of example, by such signs or reference numbers.

The invention claimed is:

1. A machine for forming "spaghetti" from vegetable products (19) comprising:

a cutting unit (11) rotatable about an operating axis (A) and having a face (12), perpendicular to said operating axis (A), from which protrude blades for forming "spaghetti" from a product (19), that is pushed against said face (12); and a supply device (14) comprising a thrust unit (15) having:

two tape members (16, 17) mutually opposing each other and define passage (18) between them for products (19); said tape members (16, 17) being positioned and configured such that said passage (18) extends along said operating axis (A) and has an outlet opening (18*a*) which faces the face (12) of said cutting unit (11); said tape members (16, 17) being spreadable in a way symmetrical with respect to said operating axis (A);

elastic means (20) connected to said tape members (16, 17) and configured to resiliently counteract a mutual spreading of said tape members (16, 17);

a fixed frame (23) to which said tape members (16, 17) are pivoted in a rotatable way, each with respect to its own axis of tilting (C, D) which lies on a plane perpendicular to said operating axis (A); said axes of tilting (C, D) being mutually parallel; and a guide device (35) which mutually interconnects said tape members (16, 17) and is configured to guide them between two configurations, a closing and an opening in which said tape members (16, 17) have a minimum divarication and a maximum divarication respectively; said guide device (35) being configured to maintain said tape members (16, 17) in mutually symmetrical position with respect to said operating axis (A), to guide a product (19) coaxially to said operating axis (A), wherein said guide device (35) includes a guide mechanism (36, 37) comprising four connecting rods (38*a*, 38*b*, 38*c*, 38*d*) and four pins (39*a*, 39*b*, 39*c*, 39*d*) arranged to form a quadrilateral whose sides are defined by said connecting rods (38*a*, 38*b*, 38*c*, 38*d*); said pins (39*a*, 39*b*, 39*c*, 39*d*) are placed at the vertices of said quadrilateral, which connect in a mutually rotating way, two of said connecting rods (38*a*, 38*b*, 38*c*, 38*d*); said fixed frame (23) being provided with two rectilinear guides (40*a*, 40*b*), parallel to said operating axis (A), and two curvilinear guides (41*a*, 41*b*) each extending circumferentially to one of said axes of tilting (C, D); said pins (39*a*, 39*b*, 39*c*, 39*d*) comprising:

two first pins (39*a*, 39*b*) defining opposite vertices of said quadrilateral, each of which is coupled to one of said rectilinear guides (40*a*, 40*b*) to slide parallel to said operating axis (A); and two second pins (39*c*, 39*d*) defining opposite vertices of said quadrilateral, each of which is coupled to one of said curvilinear guides (41*a*, 41*b*) to slide along these circumferentially to said axes of tilting (C, D); each of said second pins (39*c*, 39*d*) being fixed to one of said tape members (16, 17) to guide it.

2. The machine according to claim 1 wherein said tape members (16, 17) have respective front ends (16*a*, 17*a*), which define the outlet opening (18*a*) of said passage (18), and rear ends (16*b*, 17*b*) which define an inlet opening (18*b*) of said passage (18) and which are pivoted to said fixed frame (23) in a way rotatable with respect to said axis of tilting (C, D).

3. The machine according to claim 1, wherein each of said tape members (16, 17) comprises a mobile frame (24*a*, 24*b*), two pulleys (25, 26, 27, 28) coupled in a way rotatable to said mobile frame (24*a*, 24*b*), an element (29, 30) forming a loop and mounted on said pulleys (25, 26, 27, 28) so as to have a tract (29*a*, 30*a*) substantially rectilinear that extends between said pulleys (25, 26, 27, 28) and capable to abut on, a product (19), to drag it, in use, along said operating axis (A).

4. The machine according to claim 3, wherein said tape members (16, 17) have each a concave branch (31, 32) having a concavity centered with respect to said operating axis (A); said concave branches (31, 32) being mutually facing each other in such a way to define two sides of said passage (18) for centering on said operating axis (A) a product (19) that, in use, passes through said passage (18).

5. The machine according to claim 4, wherein each of said tape members (16, 17) comprises a formed guide (33, 34) on which the tract (29*a*, 30*a*) of said ribbon-like element (29, 30), in use, slides; said formed guide (33, 34) being configured in such a way to elastically deform said tract (29*a*, 30*a*) so that this defines said concave branch (31, 32).

6. The machine according to claim 1, wherein said guide device (35) comprises two of said guide mechanisms (36, 37) which among them comprise said tape members (16, 17).

7. The machine according to claim 1, wherein said supply device (14) comprises a supply group (42) capable to introduce products (19) in said thrust unit (15) parallel to said operating axis (A); said supply group (42) comprising a pair of conveyor belts (42*a*, 42*b*) arranged in V shape.

* * * * *